United States Patent [19]

Storez

[11] 4,183,000

[45] Jan. 8, 1980

[54] ELECTROMAGNETIC SAFETY MECHANISM

[75] Inventor: Franz J. F. Storez, Brussels, Belgium

[73] Assignee: Saunier Duval, Rueil Malmaison, France

[21] Appl. No.: 854,839

[22] Filed: Nov. 25, 1977

[30] Foreign Application Priority Data

Nov. 30, 1976 [FR] France ..... 76 36021

[51] Int. Cl.[2] ..... H01F 7/08

[52] U.S. Cl. ..... 335/263; 335/271; 137/66

[58] Field of Search ..... 335/251, 257, 255, 263, 335/271, 277; 137/66

[56] References Cited

U.S. PATENT DOCUMENTS

| | | | |
|---|---|---|---|
| 2,288,417 | 6/1942 | Paille | 137/66 |
| 2,313,890 | 3/1943 | Ray | 137/66 |
| 3,259,811 | 7/1966 | Dunn | 335/263 X |
| 3,952,774 | 4/1976 | Loveless | 335/263 X |

*Primary Examiner*—George Harris

*Attorney, Agent, or Firm*—Kenway & Jenney

[57] ABSTRACT

The fail-safe gas valve solenoid construction disclosed herein employs a fixed electromagnet which, when energized, actuates an operating rod by means of an armature which is relatively loosely secured to the shaft to permit self-alignment between the magnet and the armature. Relative movement and wear between the armature and the shaft is inhibited by an elastomeric washer or O-ring which is interposed between the armature and a corresponding or facing surface associated with the shaft, the washer being under slight compression.

8 Claims, 5 Drawing Figures

ELECTROMAGNETIC SAFETY MECHANISM

BACKGROUND OF THE INVENTION

The present invention relates to a fail-safe fuel valve employed as a safety device for thermoelectric ignition and more particularly to the mounting of the armature in such a mechanism.

The well known thermoelectric ignition safety devices that serve to shut off the flow of gas to burner equipment in case of extinction of a burner flame or of a pilot, require, as is known, an electromagnet or 2-pole magnetic core, as well as an armature plate mounted at one end of a shaft whose other end carries either a valve or a socket, depending on whether the mechanism is designed to block a flow of gas directly or by the intermediation of levers which may be engaged by the socket. To protect the magnetic core and the armature operating with it, they are surrounded by a non-magnetic metallic protective cover, e.g. of brass, or made of plastic.

In these known devices, the magnetic core is fixed rigidly on a bed-plate. On the other hand, the armature is set on the shaft in such a way that there can exist a certain free motion permitting it to be hinged with respect to the two poles of the magnetic core at the time of the operational motions of the gas equipment in which the electromagnetic safety device is incorporated. Finally, there is used a metallic washer integral with the shaft, or resting against a shoulder of the shaft, whose function, in being applied against the rear face of the armature, is to maintain the armature in a plane generally perpendicular to the shaft, and to serve possibly as a stop against the top of the housing when the armature disengages from the magnetic core.

One disadvantage of this method of mounting of the armature for self-alignment is that wear can occur between the armature and the corresponding part of the shaft to which it is attached. The shaft typically includes a portion of reduced diameter which passes through an aperture in the armature and is then typically riveted over to retain the armature. For example, energizing impulses applied to the electromagnet may cause the armature to rotate relative to the shaft and, as the result, small metallic particles may detach from the armature or from the shaft or from both parts, which particles can become attached to the magnetized surfaces of the electromagnet. These particles can bring about variation in the locking an unlocking characteristics of the valve and may even effect a total alteration of the functioning of the safety device.

SUMMARY OF THE INVENTION

The invention proposes a new attachment arrangement for the armature on the shaft which alleviates these disadvantages. In accordance with the invention, there is interposed, between the rear of the armature and the circular washer associated with the shaft, an elastic seal which is found pre-compressed at the moment of the operation of setting the extremity of the shaft, and whose role is to impede the rotation of the armature following the control impulses of the mechanism, while allowing a certain mobility to orient or to hinge itself with respect to the shaft in order to always be in perfect contact against the poles of the magnetic core.

Other objects and features will be in part pointed out and in part understood from the following description.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
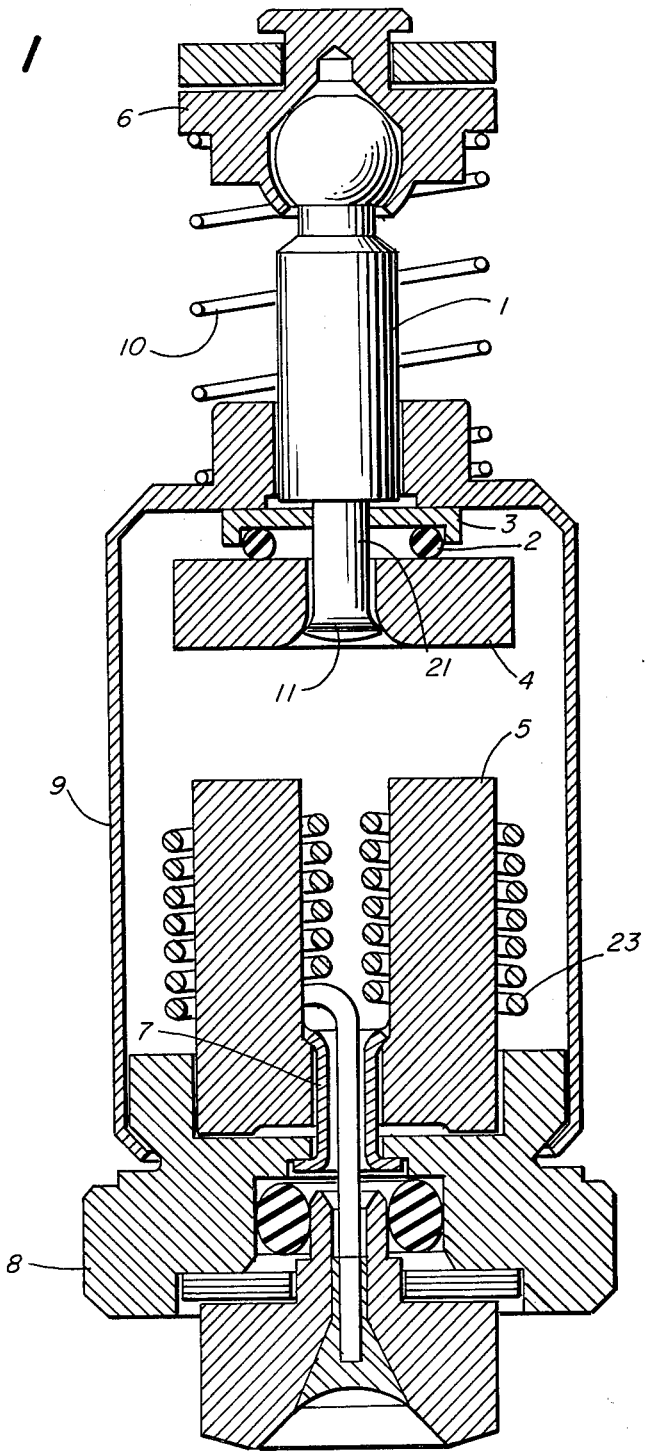
FIG. 1 is a side view, in section, of a fail-safe fuel valve employing a solenoid constructed in accordance with the present invention, including the provision of an elastic seal interposed under slight compression between the armature and a corresponding surface associated with the operating shaft.

The safety mechanism such as is represented by FIG. 1 generally includes a magnetic core 5, an armature 4 mounted at one extremity of the shaft 1, and, at the outer extremity of this shaft, a valve 6 for obstructing directly a flow of gas, this valve being able to be replaced by a cup or socket if the mechanism must act on a valve unit through the intervention of levers. The core 5 is rigidly fixed by a rivet or by a contact rivet 7 on the bed-plate 8. A protective case 9 covers the core 5 and its armature 4. A return spring 10 supported on the base covers the shaft 1 and acts on the valve 6.

The shaft 1 is journaled for axial movement in the case 9. The inner end of the shaft 1 includes a portion 21 which is of reduced diameter, the innermost end of which is riveted over, as indicated at 11, to retain the armature 4 in such a way that there exists a freedom of motion between the armature and the shaft permitting the armature to self-align with the magnetic core 5. The magnetic core 5 includes or is provided with a winding 23 which, when energized, acts on the armature 4 to draw the shaft 1 inwardly and open the fuel valve.

A circular metallic washer abuts the shoulder existing between the full and reduced diameter portions of the shaft 1. Interposed between the armature 4 and the circular metallic washer 3 and coaxial with the shaft is an O-ring 2, i.e. an elastomeric toroidal seal. The various parts are dimensioned and the riveting over of the reduced diameter portion of the shaft is carried out so that this O-ring is normally under slight compression. Accordingly, the O-ring 2 prevents the rotation of the armature and relative wear and working between the armature and the shaft 1 but, nevertheless, permits the armature to move sufficiently to self-align when it is attracted to the magnetic core 5. In that the armature does not rotate, it no longer produces either substantial wear or liberation of metallic particles caused by working between the central opening of the armature and the mating portion of the shaft. Accordingly, the operation of the solenoid valve system remains stable and predictable.

Figure 3:
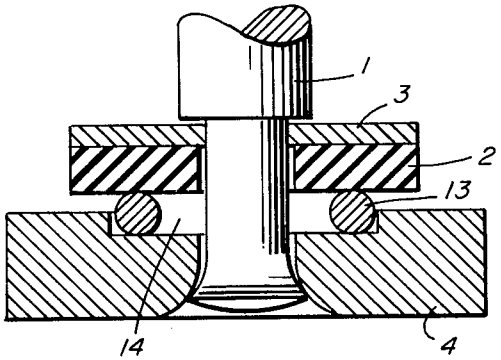
FIGS. 2–5 show alternative embodiments employing different means of providing and locating an elastic seal in accordance with the present invention.
Figure 2:
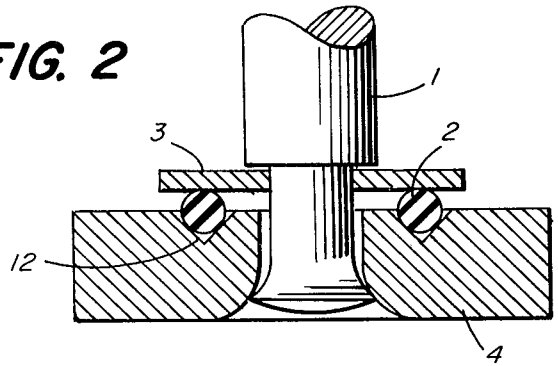

FIG. 2 illustrates another variation of embodiment of the invention, in which the toroidal seal 2 is located in a circular groove 12 obtained by machining or stamping the armature. The seal being thus held, the metallic washer 3 is level. In FIG. 3, the elastic toroidal seal is replaced by a flat seal 2, and the hinging is assured by the intervention of a metallic ring 13 located in a chamber 14 machined or stamped into the rear face of the armature 4.

Figure 4:
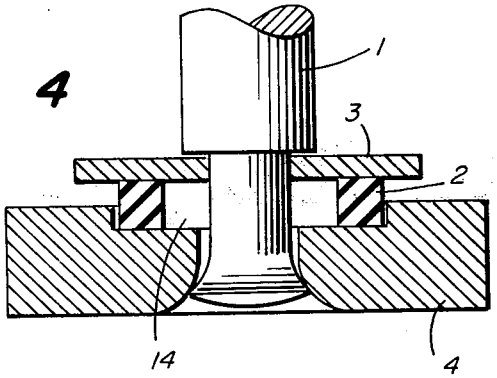

FIG. 4 is a variation of the embodiments described previously, in which the toroidal seal 2 has a square cross-section; it is located within the chamber 14 also provided in the armature.

Figure 5:
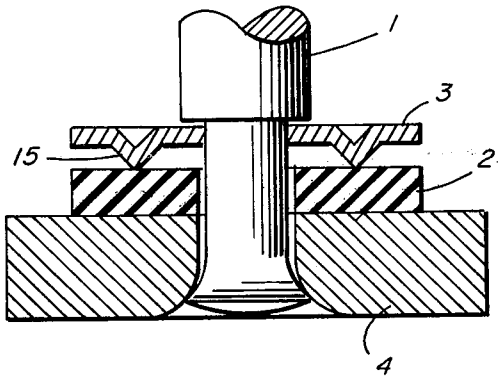

Finally, FIG. 5 shows another variation of the embodiments, showing the same advantages. The toroidal seal or the seal of square cross-section is replaced by an elastic seal 2 with rectangular cross-section, and the washer 3 has a form 15 stamped in a V, or rounded, playing the role of a hinge.

In view of the foregoing, it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

What is claimed is:

1. An electromagnetic fuel valve solenoid comprising:

a housing;

in said housing, a fixed magnet provided with an energizing winding;

an operating shaft slidable axially through a bore in said housing;

at one end of said shaft, an armature which cooperates with said magnet for actuating said shaft upon energization of said winding, said armature being loosely attached to said shaft for permitting said armature to self-align with said magnet; and between said armature and a corresponding surface of said shaft, a resilient washer which is normally under slight compression and which moves in its entirety with the armature and shaft upon energization of the fixed magnet for inhibiting relative movement and wear between said shaft and said armature.

2. Mounting of the armature of an electromagnetic safety mechanism on a shaft, on which the armature is maintained on the shaft by setting its extremity in such a way that the armature can be hinged with respect to the two poles of the magnetic core, and in which an elastic medium is held lightly compressed against the armature by a circular washer integral with the shaft and which moves in its entirety with the armature and shaft upon energization of the fixed magnet characterized by the fact that this elastic medium is an annular seal independent of the armature shaft.

3. Mounting according to claim 2, characterized by the fact that the elastic medium is a toroidal seal held by the rims of the circular washer in the form of a bowl.

4. Mounting according to claim 2, characterized by the fact that the elastic medium is a toroidal seal located within a circular groove provided on the rear face of the armature.

5. Mounting according to claim 2, characterized by the fact that the elastic medium is a flat seal which is applied against the armature by the intervention of a metallic ring located in a chamber provided on the rear face of the armature.

6. Mounting according to claim 2, characterized by the fact that the elastic medium is a toroidal seal with square cross-section, located in a chamber provided on the rear face of the armature.

7. Mounting according to claim 2, characterized by the fact that the elastic medium is a flat seal which is applied directly against the armature, and by the fact that the circular washer has a form stamped in a V, or rounded.

8. A solenoid construction for a fail-safe fuel ignition system, said solenoid construction comprising:

a housing;

in said housing, a fixed electromagnet provided with an energizing winding;

journaled in said housing for axial movement, an operating shaft, the outside end of which is adapted for operating a fuel valve mechanism and the inner end of which carries an armature which cooperates with said magnet for actuating said shaft upon energization of said winding, the inner end of said shaft having a portion of reduced diameter which is riveted over after passing through a corresponding opening in said armature to loosely retain said armature;

a rigid washer around the reduced diameter portion of said shaft but abutting the full diameter portion thereof; and between said rigid washer and said armature, an elastomeric seal which is under slight compression for inhibiting relative rotation and wear between said shaft and armature and which moves in its entirety with the armature and shaft upon energization of the fixed magnet.

* * * * *